US011648637B2

(12) United States Patent
Xue et al.

(10) Patent No.: US 11,648,637 B2
(45) Date of Patent: May 16, 2023

(54) WHEEL WEIGHT-REDUCING PIT CLEANING DEVICE

(71) Applicant: CITIC Dicastal Co., LTD, Qinhuangdao (CN)

(72) Inventors: Bowen Xue, Qinhuangdao (CN); Decai Kong, Qinhuangdao (CN); Jiandong Guo, Qinhuangdao (CN)

(73) Assignee: CITIC Dicastal Co., LTD, Qinhuangdao (CN)

( * ) Notice: Subject to any disclaimer, the term of this patent is extended or adjusted under 35 U.S.C. 154(b) by 936 days.

(21) Appl. No.: 16/548,902

(22) Filed: Aug. 23, 2019

(65) Prior Publication Data

US 2020/0139505 A1 May 7, 2020

(30) Foreign Application Priority Data

Nov. 6, 2018 (CN) ..... 201811313316.0

(51) Int. Cl.

| | |
|---|---|
| ***B24B 9/04*** | (2006.01) |
| ***B24B 29/04*** | (2006.01) |
| ***B24B 5/01*** | (2006.01) |
| ***B24B 5/12*** | (2006.01) |
| ***B24B 5/44*** | (2006.01) |
| ***B24B 29/00*** | (2006.01) |

(52) U.S. Cl.

CPC ..... *B24B 9/04* (2013.01); *B24B 5/01* (2013.01); *B24B 5/12* (2013.01); *B24B 5/44* (2013.01); *B24B 29/005* (2013.01); *B24B 29/04* (2013.01)

(58) Field of Classification Search

CPC .... B24B 5/01; B24B 5/12; B24B 5/18; B24B 5/44; B24B 9/04; B24B 29/005; B24B 29/04

USPC ..... 451/209, 210

See application file for complete search history.

(56) References Cited

U.S. PATENT DOCUMENTS 3,258,804 A * 7/1966 Fowle ..... B24B 5/225 15/104.011
4,216,560 A * 8/1980 Schmidt ..... B24B 41/06 15/268
4,527,300 A * 7/1985 Kunde ..... B60S 3/042 15/88.2
4,532,665 A * 8/1985 Evans ..... B60B 21/00 15/88.4
5,134,807 A * 8/1992 Keefe ..... B24B 7/16 451/259
5,161,281 A * 11/1992 Hanen ..... B24B 5/44 15/88.4
5,762,542 A * 6/1998 Sandvoid ..... B24B 9/002 451/301

(Continued)

FOREIGN PATENT DOCUMENTS

JP 3044289 B2 * 5/2000
JP 3091417 B2 * 9/2000

*Primary Examiner* — Eileen P Morgan
(74) *Attorney, Agent, or Firm* — Yong Chen

(57) ABSTRACT

A wheel weight-reducing pit cleaning device is provided. The wheel weight-reducing pit cleaning device comprises a lower lifting driving system, a side brush system, a ring brush unit, a ring brush system, a clamping driving system, a pressing system. The weight-reducing pit cleaning device is used for cleaning and removing the edge burrs of the drainage groove and the weight reduction groove at the wheel weight reduction pit.

1 Claim, 5 Drawing Sheets

(56) References Cited

U.S. PATENT DOCUMENTS

| | | | | |
|---|---|---|---|---|
| 6,217,424 | B1 * | 4/2001 | Stephens | B24B 29/08 451/254 |
| 7,351,130 | B1 * | 4/2008 | Chang | B24B 29/005 451/65 |
| 9,039,490 | B2 * | 5/2015 | Kelly | F01D 5/005 29/889.1 |
| 2007/0037497 | A1 * | 2/2007 | Tanaka | B24B 21/02 451/365 |
| 2013/0102233 | A1 * | 4/2013 | Ch | B24B 27/033 451/331 |
| 2014/0194038 | A1 * | 7/2014 | Lowe | B24B 9/04 451/57 |

* cited by examiner

WHEEL WEIGHT-REDUCING PIT CLEANING DEVICE

CROSS-REFERENCE TO RELATED APPLICATIONS

The present application claims the priority of Chinese patent application No. 201811313316.0, filed on Nov. 6, 2018, which is hereby incorporated by reference in its entirety.

TECHNICAL FIELD

The present disclosure relates to a cleaning device, and more particularly to a wheel weight-reducing pit cleaning device.

BACKGROUND

As the weight of the wheels directly affects the fuel economy of the vehicle, the vehicle industry continues to pursue lightweight, especially in the wheel industry. For the wheel formed by casting process, the weight-reducing pits are often arranged on the wheel flange. With the processing of the wheel flange, the edge of the weight-reducing pit will generate a lot of burrs. If the burrs are not removed in time, the wheel will cause corrosion failure in the use process. Therefore, an automatic cleaning device is needed to remove the burrs on the edge of the weight-reducing pit on the wheel flange.

SUMMARY

It is an object of the present disclosure to provide a weight-reducing pit cleaning device which, in use, is capable of cleaning and removing the burrs on the edges of the drain groove and the weight loss groove at the wheel weight-reducing pit.

In order to achieve the above object, the technical solution of the present disclosure is as follows: weight-reducing pit cleaning device, is comprised a frame, a first lower guiding post, a first lower cylinder, a first lower guiding sleeve, a first lower fixing plate, a rotary joint, a spline shaft, a first pulley, a first lower servo motor, a second pulley, a first synchronous belt, a third pulley, a first lower lifting plate, a support frame, a spline sleeve, a hollow shaft, a first bearing pedestal, a ball bowl, a guard plate, a center brush, a second lower servo motor, a second lower lifting plate, a first lower guiding rail, a first lower gear, a first lower rack, a left vertical plate, a third lower servo motor, a second lower gear, a second lower rack, a second lower guiding rail, a first sliding plate, a side brush, a first shaft, a first spring, a second shaft, a second bearing pedestal, a fourth lower servo motor, a lower overturning plate, a fifth lower servo motor, a third shaft, a third bearing pedestal, a second lower guiding post, a second lower guiding sleeve, a second lower fixing plate, a third lower lifting plate, a third lower gear, a third lower rack, a third lower guiding rail, a second sliding plate, a sixth lower servo motor, a third lower fixing plate, a second synchronous belt, a fourth pulley, a swivel, a right vertical plate, a fourth shaft, a fourth lower gear, a second spring, a first ring brush, a fifth lower gear, a second ring brush, a third spring, a fifth shaft, a third ring brush, a fourth spring, a sixth shaft, a fifth pulley, a fourth lower fixing plate, a sixth lower gear, a sixth lower ring gear, a seventh lower servo motor, an eighth lower servo motor, servo electric cylinder, a first upper cylinder, an upper fixing plate, an upper rack, an upper guiding rail, a left sliding plate, left bearing pedestals, left shafts, V-shaped rollers, a pressure head, a cross hinge, an upper shaft, an upper bearing pedestal, an upper lifting plate, upper guiding post, upper guiding sleeve, a second upper cylinder, an upper gear, right shafts, right bearing pedestals, a right sliding plate, an upper servo motor, a third synchronous belt, a sixth pulley, a ninth lower servo motor and a second lower cylinder, is characterize d in that:

a lower lifting driving system comprises: the first lower guiding sleeve are fixed below the first lower fixing plate; the first lower guiding post matching with the first lower guiding sleeve are fixed below the first lower lifting plate; the second lower cylinder are also fixed on the first fixing plate, and the output end thereof is hinged to the lower part of the first lower lifting plate; the first bearing pedestal is fixed above the first lower lifting plate; the hollow shaft is mounted inside the first bearing pedestal through a bearing; the spline sleeve is mounted inside the hollow shaft through a bearing; the spline shaft is matched with the spline sleeve; the second pulley is fixed below the hollow shaft; the guard plate is mounted on the top end of the hollow shaft through the ball bowl; the material of the portion of the guard plate corresponding to the position of the wheel weight-reducing pit is removed, and the machining part of the wheel flange surface is protected; the first lower servo motor is fixed on the left side below the first lower lifting plate through a transition flange, and the output end thereof is fixed with the third pulley; the second pulley and the third pulley are connected by the first synchronous belt; the first pulley is fixed below the spline sleeve; the ninth lower servo motor is fixed on the right side below the first lower lifting plate through a transition flange, and the output end thereof is fixed with the sixth pulley; the pulley and the sixth pulley are connected by the third synchronous belt; the support frame is fixed at the middle position below the first lower lifting plate; the first lower cylinder is fixed below the support frame, and the output end thereof is connected with the lower end of the rotary joint; the upper end of the rotary joint is connected with the lower end of the spline shaft; and the center brush is fixed on the top end of the spline shaft;

a side brush system comprises: the left vertical plate is fixed on the left side below the guard plate; the second lower lifting plate is mounted on the right side of the left vertical plate through the lower guiding rail; the first lower rack is also fixed on the right side of the left vertical plate; the third lower servo motor is fixed above the right side of the second lower lifting plate, and the output end thereof is fixed with the first lower gear; the first lower gear is meshed with the first lower rack; the third bearing pedestal is fixed below the right side of the second lower lifting plate; the third shaft is mounted inside the third bearing pedestal through a bearing; the second lower servo motor is fixed below the left side of the second lower lifting plate, the output end thereof is connected with the left side of the third shaft; the lower overturning plate is fixed on the right side of the third shaft; the first sliding plate is fixed is mounted above the lower overturning plate through the second lower guiding rail the second lower rack is fixed on the left side of the first sliding plate; the fifth lower servo motor is fixed below the lower overturning plate, and the output end thereof is fixed with the second lower end gear; the second lower gear is meshed with the second lower rack; the bearing pedestal is fixed above the first sliding plate; the second shaft is mounted inside the second bearing pedestal through a bearing; the outer side of the first shaft is matched with the inner hole of the second shaft; the spring is mounted in the inner hole above the second shaft, and is placed on the lower end of the first shaft; the side brush is fixed on the top end of the first shaft; and the fourth lower servo motor is fixed below the first sliding plate, and the output end is connected with the lower end of the second shaft;

a ring brush unit comprises: the fourth shaft is mounted on the fourth lower fixing plate through a bearing; the fourth lower gear is fixed on the outer side above the fourth shaft; the first ring brush is mounted in the hole at the upper end of the fourth shaft; the second spring is mounted in the inner hole above the fourth shaft, and is placed on the lower end of the first ring brush; the shaft is mounted on the fourth lower fixing plate through the bearing, and is placed on the fourth right side of the fourth shaft; the fifth lower gear is fixed on the outer side above the fifth shaft;

the second ring brush is mounted in the hole at the upper end of the fifth shaft; the third spring is mounted in the inner hole above the fifth shaft, and is placed on the lower end of the second ring brush the fourth lower gear is meshed with the fifth lower gear; and the fourth pulley is fixed on the lower end of the fifth shaft; the device comprises two sets of the ring brush units on left and right;

a ring brush system comprises: the second lower fixing plate is fixed on the right side below the guard plate through the right vertical plate; the second lower guiding sleeve are fixed on the second lower fixing plate; the second lower guiding post matching with the second lower guiding sleeve are fixed below the lower lifting plate; the two servo electric cylinder are fixed below the second lower fixing plate, and the output end thereof is hinged to the lower part of the third lower lifting plate the second sliding plate is mounted above the third lower lifting plate through the third lower guiding rail the third lower rack is fixed above the third lower lifting plate; the sixth lower servo motor is fixed above the second sliding plate, and the output end thereof is fixed with the lower gear the third lower gear is meshed with the lower rack; the third lower fixing plate is fixed above the second sliding plate through a transition block; the fourth lower fixing plate is mounted on the top end of the third lower fixing plate through the swivel 54; the shaft is mounted on the fourth lower fixing plate through a bearing; the third ring brush is mounted in the hole at the upper end of the sixth shaft; the fourth spring is mounted in the hole at the upper end of the sixth shaft, and is placed on the lower end of the ring brush; the fifth pulley is fixed below the shaft; the eighth lower servo motor is fixed on the lower end of the third lower fixing plate, and the output end thereof is connected to the lower part of the sixth shaft; the fourth pulley and the fifth pulley are connected by the second synchronous belt; the sixth lower ring gear is fixed to the inner ring of the swivel, and the upper end thereof is connected to the lower end of the fourth lower fixing plate; the seventh lower servo motor is fixed on the lower end of the third lower fixing plate, and the output end thereof is fixed with the sixth lower gear; and the sixth lower gear is meshed with the sixth lower ring gear;

a clamping driving system comprises: the left sliding plate and the right sliding plate are respectively mounted above the upper fixing plate through the upper guiding rail; the two left bearing pedestals are fixed above the left sliding plate; the two left shafts are respectively mounted inside the two left bearing pedestal through bearings; above the two left shafts are respectively fixed with a V-shaped roller; the two right bearing pedestals are fixed above the right sliding plate; the two right shafts are respectively mounted inside the two right bearing pedestals through bearings; above the two right shaft are respectively fixed with a V-shaped roller; the upper servo motor is fixed below the right sliding plate, and the output end thereof is connected with the lower part of one of the right shafts; the first upper cylinder is fixed above the upper fixing plate, and the output end thereof is connected with the left sliding plate; the upper gear is fixed above the upper fixing plate; the upper sliding plate and the right sliding plate are respectively fixed with the upper rack; and the upper rack is meshed with the upper gear;

a pressing system comprises: the upper bearing pedestal is fixed below the upper lifting plate; the upper shaft is mounted inside the upper bearing pedestal through a bearing; the pressure head is fixed on the lower end of the upper shaft by the cross hinge; the four upper guiding post are fixed above the upper lifting plate 86; the four upper guiding sleeve matching with the upper guiding post are fixed on the top end of the first frame; and the second upper cylinder are fixed on the top end of the frame, and the output ends thereof are hinged to the top end of the upper lifting plate.

The present disclosure in use is capable of cleaning and removing the burrs on the edges of the drain groove and the weight loss groove at the wheel weight-reducing pit.

DETAILED DESCRIPTION

Figure 1:
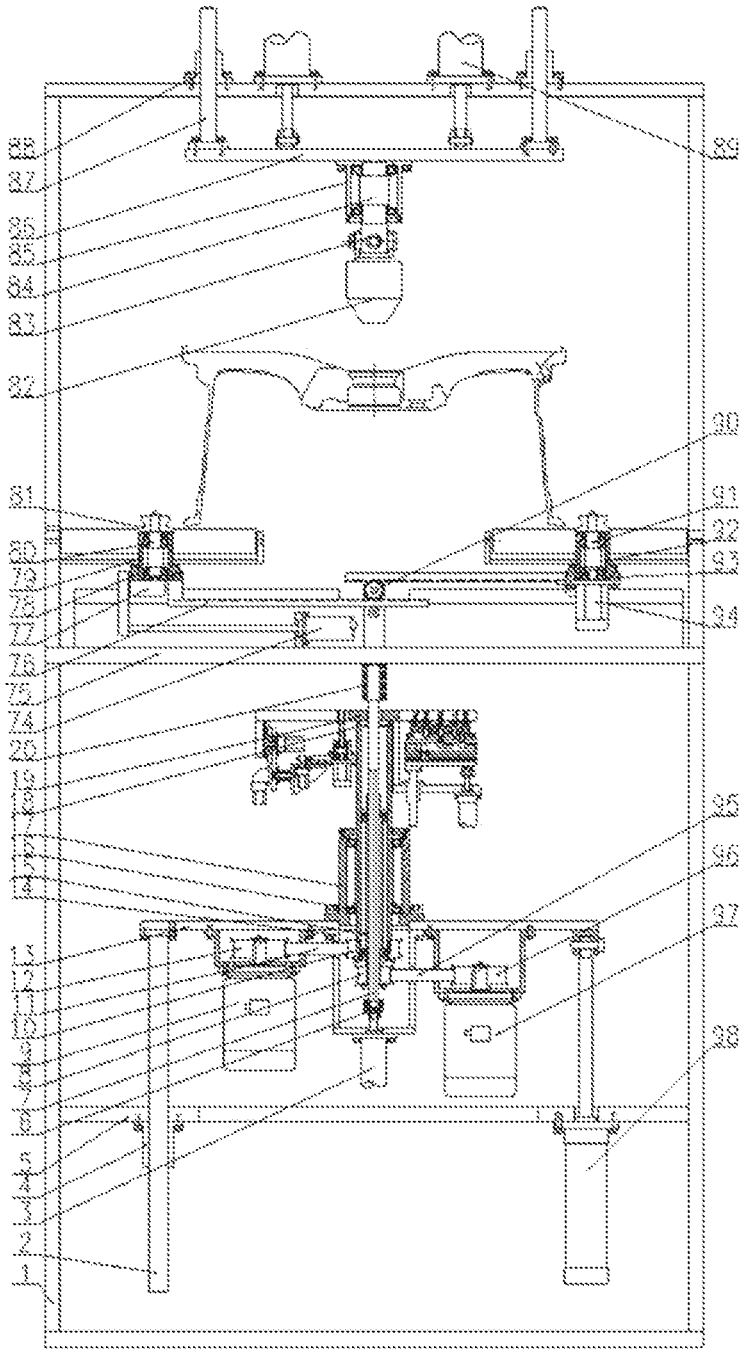
FIG. 1 is the main view of the wheel weight-reducing pit cleaning device of the present disclosure.
Figure 2:
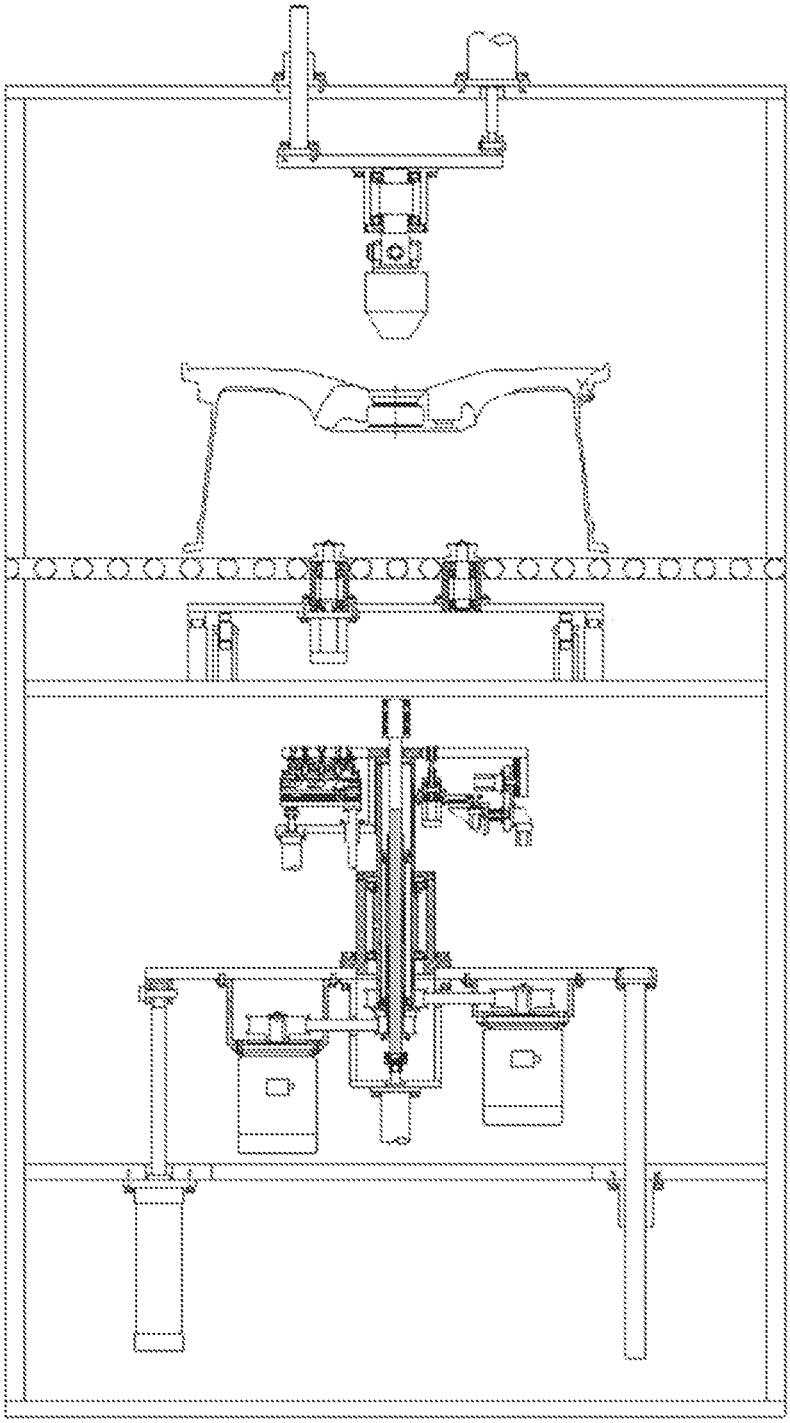
FIG. 2 is the left view . . . .
Figure 3:
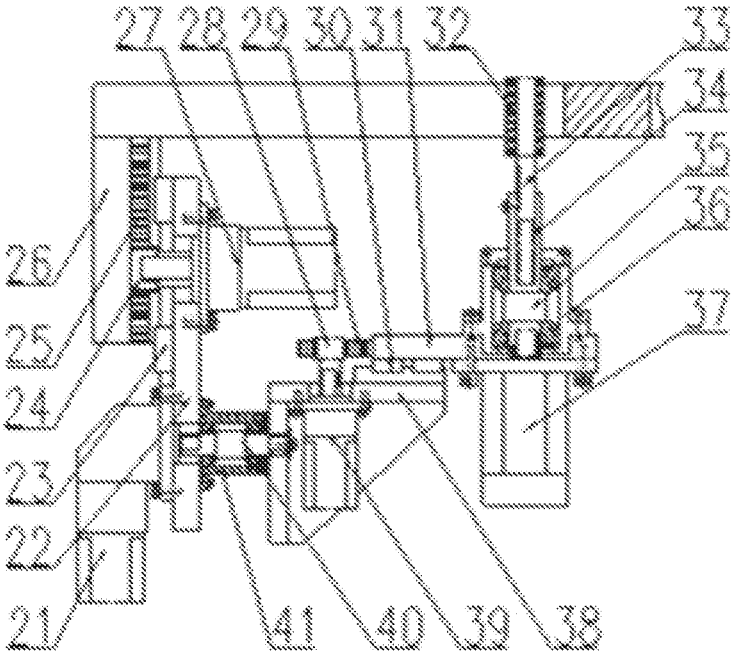
FIG. 3 is the main view of the side brush system . . . .
Figure 4:
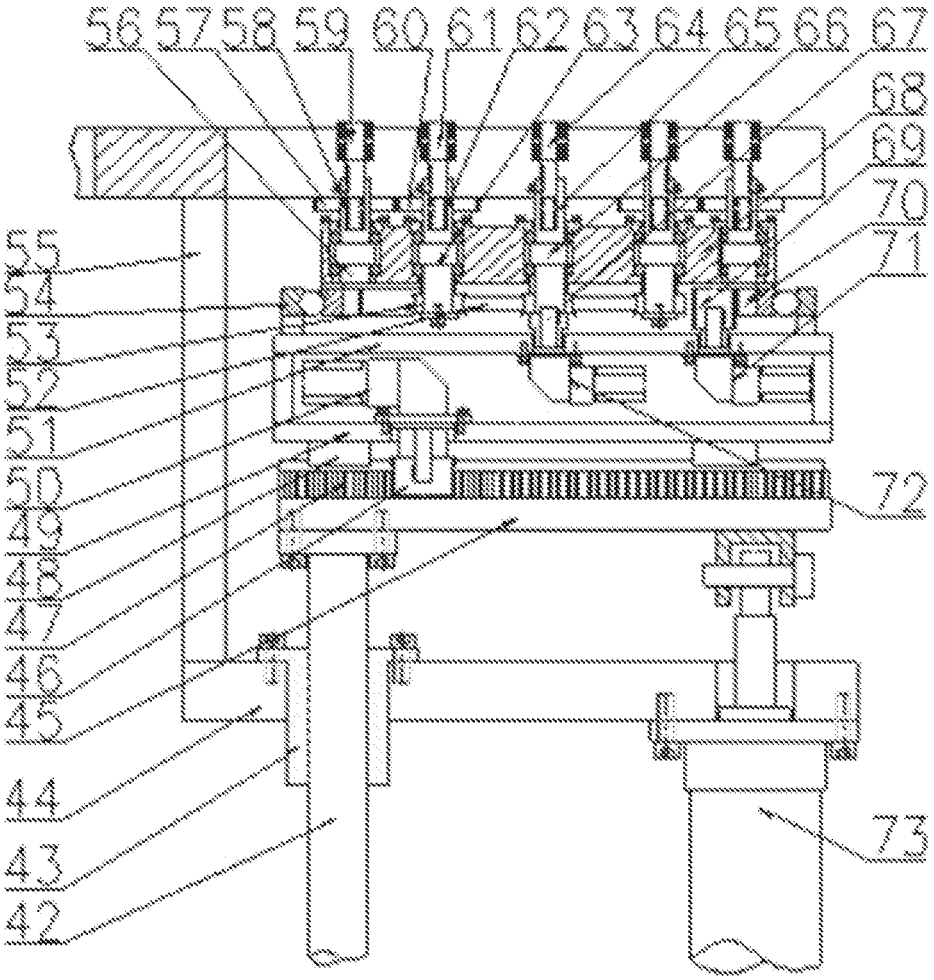
FIG. 4 is the main view of the ring brush system . . . .
Figure 5:
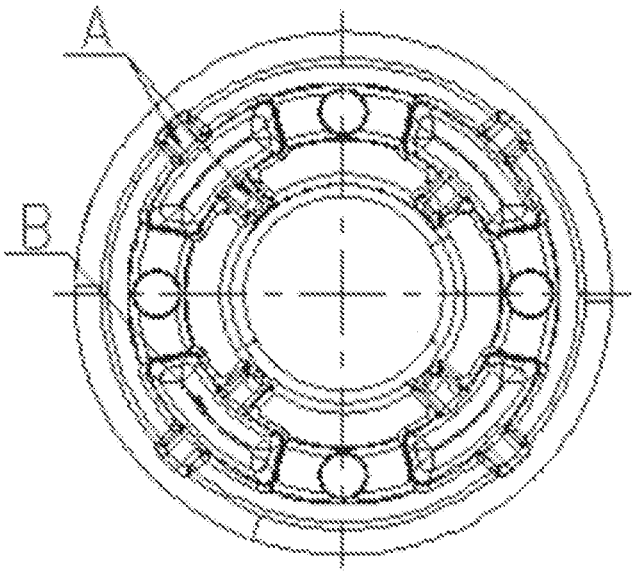
FIG. 5 is the top view of the wheel weight-reducing pit that needs to be removed . . . .

The details and operation of the specific device according to the present disclosure will be described below with reference to the accompanying drawings.

The device consists of a first frame 1, a first lower guiding post 2, a first lower cylinder 3, a first lower guiding sleeve 4, a first lower fixing plate 5, a rotary joint 6, a spline shaft 7, a first pulley 8, a first lower servo motor 9, a second pulley 10, a first synchronous belt 11, a third pulley 12, a first lower lifting plate 13, a support frame 14, a spline sleeve 15, a hollow shaft 16, a first bearing pedestal 17, a ball bowl 18, a guard plate 19, a center brush 20, a second lower servo motor 21, a second lower lifting plate 22, a first lower guiding rail 23, a first lower gear 24, a first lower rack 25, a left vertical plate 26, a third lower servo motor 27, a second lower gear 28, a second lower rack 29, a second lower guiding rail 30, a first sliding plate 31, a side brush 32, a first shaft 33, a first spring 34, a second shaft 35, a second bearing pedestal 36, a fourth lower servo motor 37, a lower overturning plate 38, a fifth lower servo motor 39, a third shaft 40, a third bearing pedestal 41, a second lower guiding post 42, a second lower guiding sleeve 43, a second lower fixing plate 44, a third lower lifting plate 45, a third lower gear 46, a third lower rack 47, a third lower guiding rail 48, a second sliding plate 49, a sixth lower servo motor 50, a third lower fixing plate 51, a second synchronous belt 52, a fourth pulley 53, a swivel 54, a right vertical plate 55, a fourth shaft 56, a fourth lower gear 57, a second spring 58, a first ring brush 59, a fifth lower gear 60, a second ring brush 61, a third spring 62, a fifth shaft 63, a third ring brush 64, a fourth spring 65, a sixth shaft 66, a fifth pulley 67, a fourth lower fixing plate 68, a sixth lower gear 69, a sixth lower ring gear 70, a seventh lower servo motor 71, an eighth lower servo motor 72, servo electric cylinder 73, a first upper cylinder 74, an upper fixing plate 75, an upper rack 76, an upper guiding rail 77, a left sliding plate 78, left bearing pedestals 79, left shafts 80, V-shaped rollers 81, a pressure head 82, a cross hinge 83, an upper shaft 84, an upper bearing pedestal 85, an upper lifting plate 86, upper guiding post 87, upper guiding sleeve 88, a second upper cylinder 89, an upper gear 90, right shafts 91, right bearing pedestals 92, a right sliding plate 93, an upper servo motor 94, a third synchronous belt 95, a sixth pulley 96, a ninth lower servo motor 97 and a second lower cylinder 98.

The lower lifting driving system comprises: the first lower guiding sleeve 4 are fixed below the first lower fixing plate 5; the first lower guiding post 2 matching with the first lower guiding sleeve 4 are fixed below the first lower lifting plate 13; the second lower cylinder 98 are also fixed on the first fixing plate 5, and the output end thereof is hinged to the lower part of the first lower lifting plate 13; the first bearing pedestal 17 is fixed above the first lower lifting plate 13; the first hollow shaft 16 is mounted inside the first bearing pedestal 17 through a bearing; the spline sleeve 15 is mounted inside the hollow shaft 16 through a bearing; the spline shaft 7 is matched with the spline sleeve 15; the second pulley 10 is fixed below the hollow shaft 16; the guard plate 19 is mounted on the top end of the hollow shaft 16 through the ball bowl 18; the material of the portion of the guard plate 19 corresponding to the position of the wheel weight-reducing pit is removed, and the machining part of the wheel flange surface is protected; the first lower servo motor 9 is fixed on the left side below the first lower lifting plate 13 through a transition flange, and the output end thereof is fixed with the third pulley 12; the second pulley 10 and the third pulley 12 are connected by the first synchronous belt 11; the first pulley 8 is fixed below the spline sleeve 15; the ninth lower servo motor 97 is fixed on the right side below the first lower lifting plate 13 through a transition flange, and the output end thereof is fixed with the sixth pulley 96; the first pulley 8 and the sixth pulley 96 are connected by the third synchronous belt 95; the support frame 14 is fixed at the middle position below the first lower lifting plate 13; the first lower cylinder 3 is fixed below the support frame 14, and the output end thereof is connected with the lower end of the rotary joint 6; the upper end of the rotary joint 6 is connected with the lower end of the spline shaft 7; and the center brush 20 is fixed on the top end of the spline shaft 7.

The side brush system comprises: the left vertical plate 26 is fixed on the left side below the guard plate 19; the second lower lifting plate 22 is mounted on the right side of the left vertical plate 26 through the first lower guiding rail 23; the first lower rack 25 is also fixed on the right side of the left vertical plate 26; the third lower servo motor 27 is fixed above the right side of the second lower lifting plate 22, and the output end thereof is fixed with the first lower gear 24; the first lower gear 24 is meshed with the first lower rack 25; the third bearing pedestal 41 is fixed below the right side of the second lower lifting plate 22; the third shaft 40 is mounted inside the third bearing pedestal 41 through a bearing; the second lower servo motor 21 is fixed below the left side of the second lower lifting plate 22, the output end thereof is connected with the left side of the third shaft 40; the lower overturning plate 38 is fixed on the right side of the third shaft 40; the first sliding plate 31 is fixed is mounted above the lower overturning plate 38 through the second lower guiding rail 30; the second lower rack 29 is fixed on the left side of the first sliding plate 31; the fifth lower servo motor 39 is fixed below the lower overturning plate 38, and the output end thereof is fixed with the second lower end gear 28; the second lower gear 28 is meshed with the second lower rack 29; the second bearing pedestal 36 is fixed above the first sliding plate 31; the second shaft 35 is mounted inside the second bearing pedestal 36 through a bearing; the outer side of the first shaft 33 is matched with the inner hole of the second shaft 35; the spring 34 is mounted in the inner hole above the second shaft 35, and is placed on the lower end of the first shaft 33; the side brush 32 is fixed on the top end of the first shaft 33; and the fourth lower servo motor 37 is fixed below the first sliding plate 31, and the output end is connected with the lower end of the second shaft 35.

The ring brush unit comprises: the fourth shaft 56 is mounted on the fourth lower fixing plate 68 through a bearing; the fourth lower gear 57 is fixed on the outer side above the fourth shaft 56; the first ring brush 59 is mounted in the hole at the upper end of the fourth shaft 56; the second spring 58 is mounted in the inner hole above the fourth shaft 56, and is placed on the lower end of the first ring brush 59; the fifth shaft 63 is mounted on the fourth lower fixing plate 68 through the bearing, and is placed on the right side of the fourth shaft 56; the fifth lower gear 60 is fixed on the outer side above the fifth shaft 63; the second ring brush 61 is mounted in the hole at the upper end of the fifth shaft 63; the third spring 62 is mounted in the inner hole above the fifth shaft 63, and is placed on the lower end of the second ring brush 61; the fourth lower gear 57 is meshed with the fifth lower gear 60; and the fourth pulley 53 is fixed on the lower end of the fifth shaft 63; the device comprises two sets of the ring brush units on left and right.

The ring brush system comprises: the second lower fixing plate 44 is fixed on the right side below the guard plate 19 through the right vertical plate 55; the second lower guiding sleeve 43 are fixed on the second lower fixing plate 44; the second lower guiding post 42 matching with the second lower guiding sleeve 43 are fixed below the third lower lifting plate 45; the two servo electric cylinder 73 are fixed below the second lower fixing plate 44, and the output end thereof is hinged to the lower part of the third lower lifting plate 45; the second sliding plate 49 is mounted above the third lower lifting plate 45 through the third lower guiding rail 48; the third lower rack 47 is fixed above the third lower lifting plate 45; the sixth lower servo motor 50 is fixed above the second sliding plate 49, and the output end thereof is fixed with the third lower gear 46; the third lower gear 46 is meshed with the third lower rack 47; the third lower fixing plate 51 is fixed above the second sliding plate 49 through a transition block; the fourth lower fixing plate 68 is mounted on the top end of the third lower fixing plate 51 through the swivel 54; the sixth shaft 66 is mounted on the fourth lower fixing plate 68 through a bearing; the third ring brush 64 is mounted in the hole at the upper end of the sixth shaft 66; the fourth spring 65 is mounted in the hole at the upper end of the sixth shaft 66, and is placed on the lower end of the ring brush; the fifth pulley 67 is fixed below the sixth shaft 66; the eighth lower servo motor 72 is fixed on the lower end of the third lower fixing plate 51, and the output end thereof is connected to the lower part of the sixth shaft 66; the fourth pulley 53 and the fifth pulley 67 are connected by the second synchronous belt 52; the sixth lower ring gear 70 is fixed to the inner ring of the swivel 54, and the upper end thereof is connected to the lower end of the fourth lower fixing plate 68; the seventh lower servo motor 71 is fixed on the lower end of the third lower fixing plate 51, and the output end thereof is fixed with the sixth lower gear 69; and the sixth lower gear 69 is meshed with the sixth lower ring gear 70.

The clamping driving system comprises: the left sliding plate 78 and the right sliding plate 93 are respectively mounted above the upper fixing plate 75 through the upper guiding rail 77; the two left bearing pedestals 79 are fixed above the left sliding plate 78; the two left shafts 80 are respectively mounted inside the two left bearing pedestal 79 through bearings; above the two left shafts 80 are respectively fixed with a V-shaped roller 81; the two right bearing pedestals 92 are fixed above the right sliding plate 93; the two right shafts 91 are respectively mounted inside the two right bearing pedestals 92 through bearings; above the two right shaft 91 are respectively fixed with a V-shaped roller 81; the upper servo motor 94 is fixed below the right sliding plate 93, and the output end thereof is connected with the lower part of one of the right shafts 91; the first upper cylinder 74 is fixed above the upper fixing plate 75, and the output end thereof is connected with the left sliding plate 78; the upper gear 90 is fixed above the upper fixing plate 75; the upper sliding plate 78 and the right sliding plate 93 are respectively fixed with the upper rack 76; and the upper rack 76 is meshed with the upper gear 90.

The pressing system comprises: the upper bearing pedestal 85 is fixed below the upper lifting plate 86; the upper shaft 84 is mounted inside the upper bearing pedestal 85 through a bearing; the pressure head 82 is fixed on the lower end of the upper shaft 84 by the cross hinge 83; the four upper guiding post 87 are fixed above the upper lifting plate 86; the four upper guiding sleeve 88 matching with the upper guiding post 87 are fixed on the top end of the frame 1; and the second upper cylinder 89 are fixed on the top end of the frame 1, and the output ends thereof are hinged to the top end of the upper lifting plate 86.

During operation, the first upper cylinder 74 causes the four V-shaped rollers 81 to synchronously clamp the wheel through the upper gear 90, the upper rack 76 and the upper guiding rail 77; the second upper cylinder 89 make the pressure head 82 press the wheel riser through the upper guiding post 87 and the upper guiding sleeve 88; the upper servo motor 94 rotates the clamped wheel through the right shaft 91; the ninth lower servo motor 97 drives the spline sleeve 15 to rotate through the first pulley 8, the sixth pulley 96 and the third synchronous belt 95; through the cooperation of the sleeve 15 with the spline shaft 7, the spline shaft 7 and the center brush 20 can be driven to rotate; the lower servo motor 9 drives the hollow shaft 16 and the guard plate 19 to rotate through the second pulley 10, the third pulley 12 and the first synchronous belt 11, and the rotation will be stopped when the guard plate 19 corresponds to the position of the weight-reducing pit of the wheel; the second lower cylinder 98 tightly fits the upper end surface of the guard plate 19 with the wheel flange through the first lower guiding post 2 and the first lower guiding sleeve 4; and at this time, the center bush 20 can remove the burrs at the center hole of the wheel, and the height of the center brush 20 can be adjusted by the lower cylinder 3 for different wheels.

The fourth lower servo motor 37 can drive the side brush 32 to rotate through the second shaft 35; the side brush 32 can be floated up and down by the first spring 34; the fifth lower servo motor 39 can achieve the adjustment of the left and right positions of the side brush 32 through the second lower gear 28, the second lower rack 29 and the second lower guiding rail 30; the third lower servo motor 27 can achieve the adjustment of the upper and lower positions of the side brush 32 through the first lower gear 24, the first lower rack 25 and the first lower guiding rail 23; and the second lower servo motor 21 can achieve the adjustment of the front and rear angles of the side brush 32 through the third shaft 40. The burrs at the edge of the drain groove can be removed when the rotating brush 32 contacts the wheel weight-reducing pit.

The eighth lower servo motor 72 can drive the fifth pulley 67 and the third ring brush 64 to rotate through the sixth shaft 66; the fourth spring 65 can achieve the floating of the ring brush 64; the fifth pulley 67 can drive the fourth pulley 53 and the fifth shaft 63 to rotate through the second synchronous belt 52; the fifth shaft 63 can drive the second ring brush 61 to rotate; the third spring 62 can achieve the floating of the second ring brush 61; the fifth lower gear 60 can drive the fourth shaft 56 and the ring brush 59 to rotate by meshing with the fourth lower gear 57; the second spring 58 can achieve the floating of the ring brush 59; the seventh lower servo motor 71 can achieve the adjustment of the angles of the fourth lower fixing plate 68 and each ring brush through the sixth lower gear 69, the sixth lower ring gear 70 and the swivel 54; the sixth lower servo motor 50 can achieve the adjustment of the left and right positions of the fourth lower fixing plate 68 and each ring brush through the third lower gear 46, the third lower rack 47 and the third lower guiding rail 48; and the servo electric cylinder 73 can achieve the adjustment of the upper and lower positions of the fourth lower fixing plate 68 and each ring brush through the second lower guiding post 42 and the second lower guiding sleeve 43. The burrs at the edge of the weight loss groove can be removed when the rotating brush contacts the wheel weight-reducing pit.

What is claimed is:

1. A wheel weight-reducing pit cleaning device, comprising a frame, a first lower guiding post, a first a lower cylinder, a first lower guiding sleeve, a first lower fixing plate, a rotary joint, a spline shaft, a first pulley, a first lower servo motor, a second pulley, a first synchronous belt, a third pulley, a first lower lifting plate, a support frame, a spline sleeve, a hollow shaft, a first bearing pedestal, a ball bowl, a guard plate, a center brush, a second lower servo motor, a second lower lifting plate, a first lower guiding rail, a first lower gear, a first lower rack, a left vertical plate, a third lower servo motor, a second lower gear, a second lower rack, a second lower guiding rail, a first sliding plate, a side brush, a first shaft, a first spring, a second shaft, a second bearing pedestal, a fourth lower servo motor, a lower overturning plate, a fifth lower servo motor, a third shaft, a third bearing pedestal, a second lower guiding post, a second lower guiding sleeve, a second lower fixing plate, a third lower lifting plate, a third lower gear, a third lower rack, a third lower guiding rail, a second sliding plate, a sixth lower servo motor, a third lower fixing plate, a second synchronous belt, a fourth pulley, a swivel, a right vertical plate, a fourth shaft, a fourth lower gear, a second spring, a first ring brush, a fifth lower gear, a second ring brush, a third spring, a fifth shaft, a third ring brush, a fourth spring, a sixth shaft, a fifth pulley, a fourth lower fixing plate, a sixth lower gear, a sixth lower ring gear, a seventh lower servo motor, an eighth lower servo motor, a servo electric cylinder, a first upper cylinder, an upper fixing plate, an upper rack, an upper guiding rail, a left sliding plate, a left bearing pedestal, a left shaft, a V-shaped roller, a pressure head, a cross hinge, an upper shaft, an upper bearing pedestal, an upper lifting plate, an upper guiding post, an upper guiding sleeve, a second upper cylinder, an upper gear, a right shaft, a right bearing pedestal, a right sliding plate, an upper servo motor, a third synchronous belt, a sixth pulley, a ninth lower servo motor and a second lower cylinder, is characterized in that:

a lower lifting driving system comprises: the first lower guiding sleeve is fixed below the first lower fixing plate; the first lower guiding post matching with the first lower guiding sleeve is fixed below the first lower lifting plate; the second lower cylinder is also fixed on the first fixing plate, and an output end thereof is hinged to a lower part of the first lower lifting plate; the first bearing pedestal is fixed above the first lower lifting plate; the hollow shaft is mounted inside the first bearing pedestal through a bearing; the spline sleeve is mounted inside the hollow shaft through a bearing; the spline shaft is matched with the spline sleeve; the second pulley is fixed below the hollow shaft; the guard plate is mounted on a top end of the hollow shaft through the ball bowl; the material of the portion of the guard plate corresponding to a position of the wheel weight-reducing pit is removed, and a machining part of a wheel flange surface is protected; the first lower servo motor is fixed on a left side below the first lower lifting plate through a transition flange, and an output end thereof is fixed with the third pulley; the second pulley and the third pulley is connected by the first synchronous belt; the first pulley is fixed below the spline sleeve; the ninth lower servo motor is fixed on a right side below the first lower lifting plate through a transition flange, and an output end thereof is fixed with the sixth pulley; the pulley and the sixth pulley is connected by the third synchronous belt; the support frame is fixed at a middle position below the first lower lifting plate; the first lower cylinder is fixed below the support frame, and an output end thereof is connected with a lower end of the rotary joint; an upper end of the rotary joint is connected with a lower end of the spline shaft; and the center brush is fixed on a top end of the spline shaft;

a side brush system comprises: the left vertical plate is fixed on a left side below the guard plate; the second lower lifting plate is mounted on a right side of the left vertical plate through the first lower guiding rail; the first lower rack is also fixed on the right side of the left vertical plate; the third lower servo motor is fixed above a right side of the second lower lifting plate, and an output end thereof is fixed with the first lower gear; the first lower gear is meshed with the first lower rack; the third bearing pedestal is fixed below a right side of the second lower lifting plate; the third shaft is mounted inside the third bearing pedestal through a bearing; the second lower servo motor is fixed below a left side of the second lower lifting plate, an output end thereof is connected with a left side of the third shaft; the lower overturning plate is fixed on a right side of the third shaft; the first sliding plate is fixed is mounted above the lower overturning plate through the second lower guiding rail the second lower rack is fixed on a left side of the first sliding plate; the fifth lower servo motor is fixed below the lower overturning plate, and an output end thereof is fixed with the second lower gear; the second lower gear is meshed with the second lower rack; the second bearing pedestal is fixed above the first sliding plate; the second shaft is mounted inside the second bearing pedestal through a bearing; an outer side of the first shaft is matched with an inner hole of the second shaft; the spring is mounted in an inner hole above the second shaft, and is placed on a lower end of the first shaft; the side brush is fixed on a top end of the first shaft; and the fourth lower servo motor is fixed below the first sliding plate, and an output end of the fourth lower servo motor is connected with a lower end of the second shaft;

a ring brush unit comprises: the fourth shaft is mounted on the fourth lower fixing plate through a bearing; the fourth lower gear is fixed on an outer side above the fourth shaft; the first ring brush is mounted in a hole at an upper end of the fourth shaft; the second spring is mounted in an inner hole above the fourth shaft, and is placed on a lower end of the first ring brush; the fourth shaft is mounted on the fourth lower fixing plate through the bearing, and is placed on the fourth right side of the fourth shaft; the fifth lower gear is fixed on an outer side above the fifth shaft;

the second ring brush is mounted in a hole at an upper end of the fifth shaft; the third spring is mounted in an inner hole above the fifth shaft, and is placed on a lower end of the second ring brush the fourth lower gear is meshed with the fifth lower gear; and the fourth pulley is fixed on a lower end of the fifth shaft; the wheel weight-reducing pit cleaning device comprises two sets of the ring brush units on left and right;

a ring brush system comprises: the second lower fixing plate is fixed on a right side below the guard plate through the right vertical plate; the second lower guiding sleeve is fixed on the second lower fixing plate; the second lower guiding post matching with the second lower guiding sleeve is fixed below the third lower lifting plate; the servo electric cylinder is fixed below the second lower fixing plate, and an output end thereof is hinged to a lower part of the third lower lifting plate, the second sliding plate is mounted above the third lower lifting plate through the third lower guiding rail the third lower rack is fixed above the third lower lifting plate; the sixth lower servo motor is fixed above the second sliding plate, and an output end thereof is fixed with the third lower gear; the third lower gear is meshed with the third lower rack; the third lower fixing plate is fixed above the second sliding plate through a transition block; the fourth lower fixing plate is mounted on a top end of the third lower fixing plate through the swivel; the sixth shaft is mounted on the fourth lower fixing plate through a bearing; the third ring brush is mounted in a hole at an upper end of the sixth shaft; the fourth spring is mounted in a hole at an upper end of the sixth shaft, and is placed on a lower end of the ring brush; the fifth pulley is fixed below the sixth shaft; the eighth lower servo motor is fixed on a lower end of the third lower fixing plate, and an output end thereof is connected to a lower part of the sixth shaft; the fourth pulley and the fifth pulley is connected by the second synchronous belt; the sixth lower ring gear is fixed to an inner ring of the swivel, and an upper end thereof is connected to a lower end of the fourth lower fixing plate; the seventh lower servo motor is fixed on a lower end of the third lower fixing plate, and an output end thereof is fixed with the sixth lower gear; and the sixth lower gear is meshed with the sixth lower ring gear;

a clamping driving system comprises: the left sliding plate and the right sliding plate is respectively mounted above the upper fixing plate through the upper guiding rail; the left bearing pedestal is fixed above the left sliding plate; the left shaft is respectively mounted inside the left bearing pedestal through bearing; above the left shaft is fixed with the V-shaped roller; the right bearing pedestal is fixed above the right sliding plate; the right shaft is respectively mounted inside the right bearing pedestal through bearings; above the right shaft-is fixed with the V-shaped roller; the upper servo motor is fixed below the right sliding plate, and an output end thereof is connected with a lower part of one of the right shaft; the upper cylinder is fixed above the upper fixing plate, and an output end thereof is connected with the left sliding plate; the upper gear is fixed above the upper fixing plate; the upper sliding plate and the right sliding plate are respectively fixed with the upper rack; and the upper rack is meshed with the upper gear;

a pressing system comprises: the upper bearing pedestal is fixed below the upper lifting plate; the upper shaft is mounted inside the upper bearing pedestal through a bearing; the pressure head is fixed on a lower end of the upper shaft by the cross hinge; the upper guiding post is fixed above the upper lifting plate; the upper guiding sleeve matching with the upper guiding post is fixed on a top end of the first frame; and the second upper cylinder is fixed on a top end of the frame, and an output end thereof is hinged to a top end of the upper lifting plate;

during operation, the first upper cylinder causes the V-shaped roller to synchronously clamp the wheel through the upper gear, the upper rack and the upper guiding rail; the second upper cylinder make the pressure head press the wheel riser through the upper guiding post and the upper guiding sleeve; the upper servo motor rotates the clamped wheel through the right shaft; the ninth lower servo motor drives the spline sleeve to rotate through the first pulley, the sixth pulley and the third synchronous belt; through the cooperation of the sleeve with the spline shaft, the spline shaft and the center brush can be driven to rotate; the first lower servo motor drives the hollow shaft and the guard plate to rotate through the second pulley, the third pulley and the first synchronous belt, and the rotation will be stopped when the guard plate corresponds to the position of the weight-reducing pit of the wheel; the second lower cylinder tightly fits an upper end surface of the guard plate with the wheel flange through the first lower guiding post and the first lower guiding sleeve; and at this time, the center brush can remove burrs at a center hole of the wheel.

* * * * *